United States Patent [19]

Nakamura et al.

[11] Patent Number: 4,564,339

[45] Date of Patent: Jan. 14, 1986

[54] SCROLL COMPRESSOR

[75] Inventors: Toshiyuki Nakamura; Tsutomu Inaba; Tadashi Kimura, all of Wakayama, Japan

[73] Assignee: Mitsubishi Denki Kabushiki Kaisha, Tokyo, Japan

[21] Appl. No.: 599,356

[22] Filed: Apr. 12, 1984

[30] Foreign Application Priority Data

Jun. 3, 1983 [JP] Japan ..... 58-99671

[51] Int. Cl.[4] ..... F04B 39/02; F04B 39/06; F04C 18/02; H02K 9/08

[52] U.S. Cl. ..... 417/366; 418/55; 310/57; 310/87

[58] Field of Search ..... 417/366, 369, 372, 902; 418/55, DIG. 1; 310/57, 87

[56] References Cited

U.S. PATENT DOCUMENTS 2,069,767 2/1937 McCormack ..... 417/902 X
2,178,811 11/1939 Sateren ..... 417/902 X
3,285,504 11/1966 Smith ..... 417/372
3,713,513 1/1973 Harris et al. ..... 417/372 X
4,431,388 2/1984 Eber et al. ..... 417/902 X

FOREIGN PATENT DOCUMENTS 57-137664 8/1982 Japan ..... 417/372

*Primary Examiner*—Carlton R. Croyle
*Assistant Examiner*—Theodore W. Olds
*Attorney, Agent, or Firm*—Sughrue, Mion, Zinn, Macpeak & Seas

[57] ABSTRACT

A scroll compressor in which depletion of the lubricant supply is prevented both during the normal operation of the compressor and at the time the compressor is started. A motor cover having the form of a bottomed cylinder is provided around a driving motor of the compressor at a position so as to separate the path of suctioned gas which is used for cooling the driving motor from a lubricant return path through which lubricant from the lubricant pool formed at the bottom of the housing of the compressor is pumped to lubricate the bearing frame and returned to the lubricant pool. A check valve may be provided within the motor cover.

12 Claims, 8 Drawing Figures

SCROLL COMPRESSOR

BACKGROUND OF THE INVENTION

The present invention relates to a scroll compressor, which may be used as an air compressor or coolant compressor.

FIGS. 1A through 1D show the essential components of a scroll compressor. In these figures, reference numeral 1 designates a stationary scroll, 2 an oscillating scroll, 3 a discharge port, 4 a compression chamber, O a fixed point on the stationary scroll, and O' a fixed point on the oscillating scroll. The stationary scroll 1 and the oscillating scroll 2 have a complementary spiral configuration in cross section. More specifically, each scroll is made, for instance, involuted in cross section, according to a technique well known in the art.

The operation of the scroll 1 compressor will be described. As shown in FIGS. 1A through 1D, the scroll is held stationary while the scroll 2 is oscillated in an orbiting motion with its angular orientation maintained unchanged. Positions of the two scrolls at angles of 0°, 90°, 180° and 270° of the 360° cycle of movement thereof are indicated in FIGS. 1A through 1D, respectively. As the scroll 2 moves through this cycle, the volumes of crescent-shaped compression chambers 4 formed by the scrolls 1 and 2 first decrease, at which time the air (or other fluid) taken into the compression chambers is compressed. Then the air is discharged through the discharge port 3. In this operation, the distance OO' between the fixed points O and O' is maintained unchanged. That is, $$OO' = p/2 - t,$$

where p is the gap width between the spiral structures (corresponding to the pitch of the spiral curve) and t is the thickness of the spiral arms of the scrolls.

An example of a conventional coolant compressor operating in accordance with the above-described principle will be described with reference to FIG. 2. In FIG. 2, reference numeral 1 designates a stationary scroll, 2 an oscillating scroll, 3 a discharge port, 4 a compression chamber, 5 a main shaft, 6 a lubricating hole formed in the main shaft, 7 and 8 bearing frames, 9 a motor rotor, 10 a motor stator, 11 a housing, 12 an Oldham coupling, 13 a baffle plate, 14 an oil pool formed at the bottom of the housing 1, 15 a coolant gas intake pipe, 16 a discharge pipe, 17 an oscillating bearing formed eccentically in the main shaft and engaged with an oscillating scroll shaft 2*a*, 18 a main bearing fitted on the upper portion of the main shaft 5, 19 a motor bearing fitted on the lower portion of the main shaft 5, 20 and 21 oil return holes of an oil path, 22 and 23 communicating holes of a gas suction path, and 24 a suction hole of the gas suction path.

The stationary scroll 1 is secured to the bearing frame 7 with screws. The shaft 2*a* of the oscillating scroll 2 is engaged with the main shaft 5. The main shaft 5 is rotatably supported by the bearing frames 7 and 8, which are coupled to one another by means of a faucet joint or the like. The motor rotor 9 is fixedly secured to the main shaft 5 by press fitting or shrink fitting or with screws. The motor stator 10 is fixedly secured to the bearing frame 8 in the same manner. The Oldham coupling 12, arranged between the oscillating scroll 2 and the bearing frame 7, prevents rotation of the oscillating scroll 2. The above components are housed in the housing 11.

The operation of the scroll compressor thus assembled will be described. When the motor rotor 9 rotates, the rotary motion of the rotor 9 is transmitted through the shaft 5 as is converted to orbital motion of the oscillating scroll 2 by means of bearings 17, 18; that is, the oscillating scroll 2 is orbited, as a result of which compression is started according to the operating principle described with reference to FIGS. 1A through 1D. In this operation, the coolant gas is sucked into the compressor through the intake pipe, flowing through communication hole 22, the motor air gap, etc. to cool the motor. Thereafter, the coolant gas is introduced through the communication hole 23 and the suction hole 4 of the stationary scroll 1 into the compression chamber 4 where it is compressed. The compressed gas is discharged from the compressor through the discharge port 3 and the discharge pipe 16. The lubricant from the oil pool 14 passes through the lubricating hole 6 formed in the main shaft 5 and from there is supplied to the sliding parts of the bearings 17, 18 and 19 by a centrifugal pumping action. The lubricant is returned to the oil pool 14 through the oil return holes 20 and 21 in the bearing frames 7 and 8. To prevent lubricant dripping from the sliding parts of the bearings 17 and 18 from being sucked directly into the compression chamber 4, the baffle plate 13 is provided to separate the compression chamber from the sliding mechanism.

In the conventional scroll compressor described above, lubricant discharged through the oil return hole 21 is liable to be atomized upon meeting the gas flowing through the communication hole 22, etc., and hence a portion of the lubricant passing through the communication hole 23 is liable to be sucked into the compression chamber 4 together with the intake gas. Furthermore, when the compressor is started, frequently coolant gas mixed with the lubricant in the oil pool 14 causes the lubricant to foam, as a result of which gas and lubricant are sucked together through the hole 23 into the compression chamber 4 and are then discharged. In such a case, the compressor may quickly be depleted of lubricant. As a result, the compressor may not be sufficiently lubricated and the bearings may be damaged or they may seize.

SUMMARY OF THE INVENTION

Overcoming the above-mentioned difficulties, the invention provides a scroll compressor in which a motor cover is connected to the lower portion of the bearing frame in order to separate the lubricant path from the coolant gas suction path, thereby preventing the depletion of the supply of lubricant during operation, as well as the depletion of lubricant which may be caused by the foaming of the lubricant at the time the compressor is started, thereby eliminating the bearing problems which plagued prior art compressors.

DESCRIPTION OF THE PREFERRED EMBODIMENTS

Figure 1A:
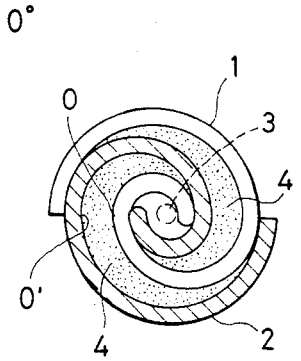
FIG. 1A PRIOR ART
FIGS. 1A through 1D are explanatory diagrams used for a description of the operating principles of a scroll compressor.
Figure 1D:
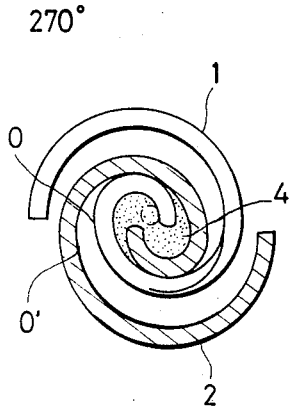
FIG. 1D PRIOR ART
Figure 1B:
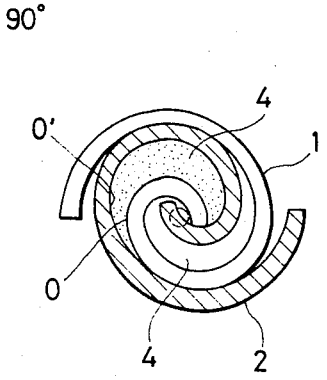
FIG. 1B PRIOR ART
Figure 1C:
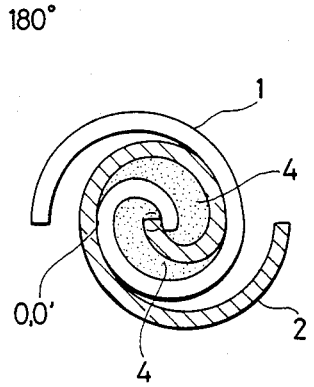
FIG. 1C PRIOR ART
Figure 2:
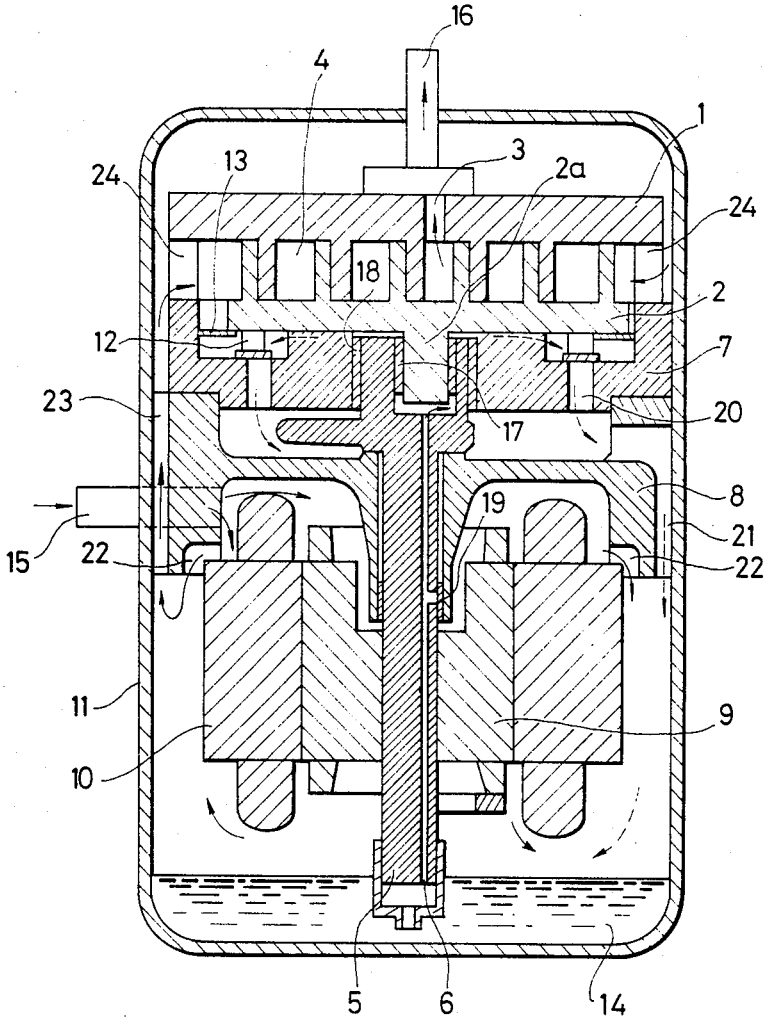
FIG. 2 PRIOR ART
FIG. 2 is a cross-sectional view of a conventional scroll compressor.
Figure 3:
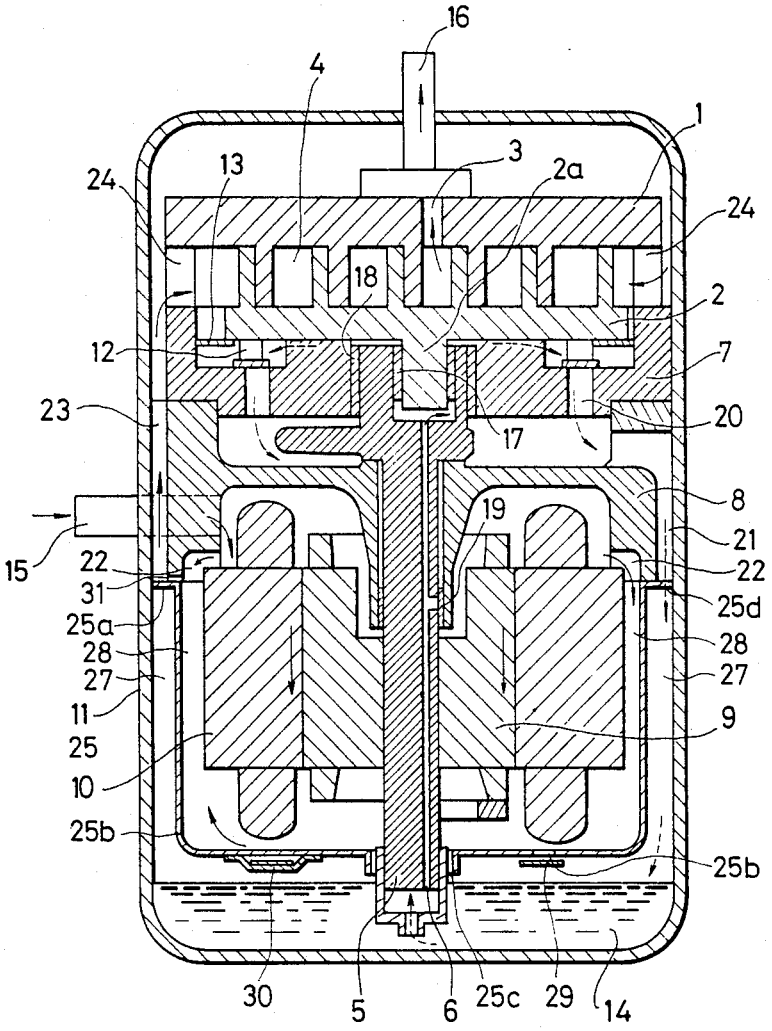
FIG. 3 is a cross-sectional view of a scroll compressor of the invention.
Figure 4:
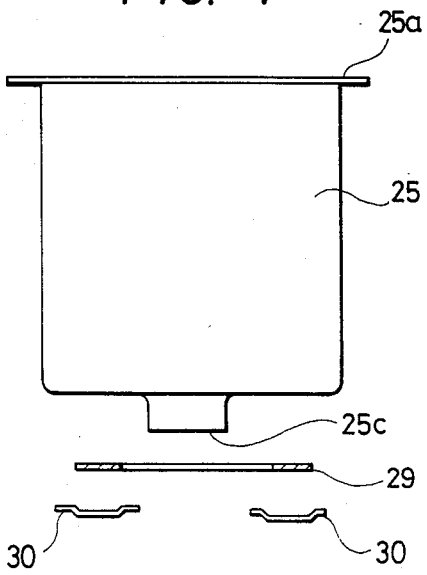
FIG. 4 is an exploded view of essential components of the scroll compressor according to the invention.
Figure 5:
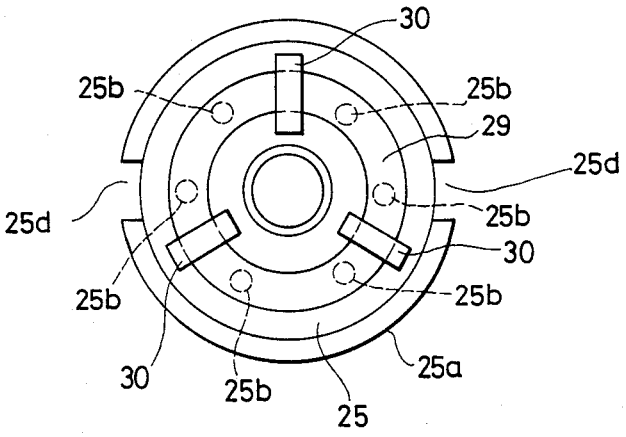
FIG. 5 is a bottom view of the essential components shown in FIG. 4.

A preferred embodiment of the invention will be described with reference to FIGS. 3, 4 and 5, in which those components which have been previously described with reference to FIGS. 1 and 2 are similarly numbered. In FIGS. 3, 4 and 5, reference numeral 25 designates a motor cover made of a thin plate. More specifically, the motor cover 25 is in the form of a bottomed cylinder having an annular flange 25*a* formed around its top opening. The flange 25*a* is secured to the lower end of the bearing frame 8 with screws or the like. The inner wall of the motor cover 25 and the motor stator 10 form a gap 28, and the outer wall of the motor cover 25 and the inner wall of the shell 11 form a gap 27. Therefore, the gaps 27 and 28 are arranged concentrically. The motor cover 25 has a through hole 25*c* at the center of the bottom thereof through which the lower portion of the main shaft 5 extends. A plurality of holes 25*b* are formed in the bottom of the motor cover 25 along the perimeter of a circle. A ring-shaped check valve 29 is held on the outer surface of the bottom of the motor cover with a retaining member 30 in such a manner that it covers the holes 25*b*. FIG. 4 shows an exploded view of the motor cover 25.

The motor cover 25 is secured to the frame 8 via a flange 25*a* in such a manner as to close off the communication hole 23 from the chamber containing oil pool 14 or the gap 27. As is shown best in FIG. 5, the flange 25*a* is provided with cuts 25*d*. The oil returning holes 21 of the bearing frame, which communicate with the gap 27 through the cuts 25*d*, are used to return lubricant to the oil pool 14.

The arrangement of the scroll compressor shown in FIGS. 3, 4 and 5 is the same as that of the conventional scroll compressor shown in FIGS. 1 and 2 except for those features described above.

The flows of coolant gas and lubricant will be described. This flow of coolant gas is as indicated by the solid line arrows in FIG. 3. More specifically, the coolant gas passes through the communication hole 22 and the motor air gap 28 to cool the motor, and then passes through the communication holes 31 and 23 to be sucked into the stationary scroll suction opening 24. After being compressed, it flows into the discharge opening to be discharged from the discharge pipe 16. The flow of lubricant is as indicated by the dashed line arrows. More specifically, the lubricant in the oil pool 14 is passed through the oil supplying hole 6 and supplied to the contact parts of the bearings 17, 18 and 19 by the centrifugal pumping action. Thereafter, the lubricant passes through the oil returning holes 20 and 21, the cuts 25*d* of the flange 25*a* of the motor cover 25 and the gap 27 to return to the oil pool 14.

As is apparent from the above description, the main path of coolant gas is completely separated from the main path of the lubricant by the motor cover 25. Accordingly, the depletion of lubricant during operation is prevented. Some small amount of lubricant may leak from the bearing 19 into the intake gas flow. However, by far the larger part of the lubricant, together with the coolant gas, flows downwardly through the air gap between the motor rotor 9 and the motor stator 10. Where the direction of flow of the coolant gas changes by 180°, that is, where the coolant gas flows upwardly below the motor, the lubricant is separated from the coolant gas because the former is heavier than the latter. As a result, the lubricant flows through the holes in the bottom of the motor cover 25 into the oil pool 14. The lubricant thus recovered is recirculated. Even if the lubricant foams when the compressor 13 is started, since the check valve 29 closes the holes 25*b* of the motor cover 25, the foamed lubricant will not flow into the suction path, and therefore depletion of the lubricant supply due to the foaming of lubricant is prevented. In the described embodiment, the check valve 29 for the holes 25*b* of the motor cover 25 is annularly shaped. However, it goes without saying that the invention is not limited thereto or thereby.

As is apparent from the above description, according to the invention, the flow of coolant gas is completely separated from the flow of lubricant by the motor cover. Accordingly, depletion of lubricant in the compressor during operation is prevented. Furthermore, depletion of lubricant due to foaming is prevented. Thus, the bearings of the compressor are free from the difficulties which are inherent to the prior art structure. Since it is unnecessary to increase the quantity of lubricant in the oil pool to compensate for depletion, the compressor can accordingly be reduced in size.

We claim:

1. In a scroll compressor of a type including a stationary scroll and a motor driven oscillating scroll, said stationary scroll and said oscillating scroll together forming a compression chamber, said oscillating scroll being orbited relative to said stationary scroll, wherein the improvement comprises means for maintaining substantially separate an operating gas and a lubricant of said compressor, said means comprising cover means for said motor, said cover means comprising a boundary between an operating gas flow path and a lubricant flow path, said operating gas flow path including a portion extending interiorally of said cover means.

2. The scroll compressor as claimed in claim 1, wherein said compressor comprises a low-pressure housing-sealed type scroll compressor comprising: a bearing frame including a compression mechanism arranged in an upper portion thereof and a driving electric motor arranged in a lower portion thereof; and a sealing housing arranged around said bearing frame, a lubricant pool being formed in a bottom portion of said housing; and wherein said cover means comprises a motor cover shaped and positioned to separate said operating gas flow path for cooling said driving motor from said lubricant flow path, through which lubricant from said lubricant pool formed at the bottom of said housing is pumped to lubricate sliding parts of said bearing frame and is returned to said lubricant pool.

3. The scroll compressor as claimed in claim 2, further comprising a check valve provided in said motor cover.

4. The scroll compressor as claimed in claim 2, wherein said motor cover has the form of a bottomed cylinder.

5. The scroll compressor is claimed in claim 3, wherein said check valve is provided with a plurality of inlet openings located along a bottom of said motor cover.

6. The scroll compressor as claimed in claim 4, wherein said motor cover has an outwardly extending flange formed at a top portion thereof for securing said cover and for forming a portion of said operating gas flow path, cuts being formed in said flange to form a portion of said lubricant flow path.

7. The scroll compressor as claimed in claim 1, further comprising a bearing frame on which said stationary scroll and oscillating scroll are mounted, and a sealing housing arranged around said bearing frame and enclosing both of said scrolls and said motor, a lubricant pool being formed in a bottom portion of said housing, said lubricant flow path extending downwardly along with an interior surface of said sealing housing to said lubricant pool.

8. The scroll compressor as claimed in claim 2 or 7, further comprising a main shaft rotatably supported by said bearing frame and rotated by said motor, a shaft of said oscillating scroll extending downwardly and at its lower portion engaging an upper portion of said main shaft through a bearing, a lubricating hole eccentrically formed in said main shaft, lubricant reserved in said lubricant pool being directed upwardly through said hole, and, through said bearing, returned to an upper portion of said lubricant flow path.

9. The scroll compressor as claimed in claim 8, further comprising a lubricant return hole passing downwardly through said bearing frame, said lubricant supplied to said bearing being returned through said lubricant return hole to said lubricant pool.

10. The scroll compressor claimed in claim 9, further comprising an Oldham coupling lubricated by said lubricant delivered from said bearing to said lubricant return hole.

11. The scroll compressor claimed in claim 2 or 7, further comprising an intake pipe having an inner end communicated with a space between a lower surface of said bearing frame and an upper surface of said motor, and a discharge pipe having an inner end communicated with a discharge port of said stationary scroll, gas flowing into said space from said intake pipe being drawn into said compression chamber through said gas flow path, and compressed gas being discharged from said discharge port of said stationary scroll into said discharge pipe.

12. The scroll compressor claimed in claim 1, 2 or 7, wherein said gas flow path comprises at least two parallel paths, one of which is formed between said cover and a stator of said motor and the other of which is formed between said stator and a rotor of said motor.

* * * * *